US007607588B2

(12) United States Patent
Nobili

(10) Patent No.: US 7,607,588 B2
(45) Date of Patent: Oct. 27, 2009

(54) SINK SPRAY HEAD WITH SUPPLY JET VARIATION AND FLOW RATE REGULATION

(76) Inventor: Fabrizio Nobili, Zona Industriale, San Vittore (CH) CH-6534

( * ) Notice: Subject to any disclaimer, the term of this patent is extended or adjusted under 35 U.S.C. 154(b) by 205 days.

(21) Appl. No.: 11/680,448

(22) Filed: Feb. 28, 2007

(65) Prior Publication Data

US 2007/0210181 A1 Sep. 13, 2007

(30) Foreign Application Priority Data

Feb. 28, 2006 (IT) ..... MI2006A0358

(51) Int. Cl.

| | |
|---|---|
| ***A01G 27/00*** | (2006.01) |
| *A62C 31/00* | (2006.01) |
| *B05B 9/01* | (2006.01) |
| *B05B 1/30* | (2006.01) |
| *B05B 15/08* | (2006.01) |

(52) U.S. Cl. ..... 239/68; 239/67; 239/587.3; 239/583; 239/586; 239/574; 239/525; 239/569; 239/445; 239/447; 239/448; 239/449; 137/613; 137/614.11; 137/614.13

(58) Field of Classification Search ..... 239/587.3, 239/68, 67, 583, 586, 574, 569, 445, 447, 239/448, 449; 137/613, 614.11, 614.13
See application file for complete search history.

(56) References Cited

U.S. PATENT DOCUMENTS

| | | | | |
|---|---|---|---|---|
| 712,868 | A | 11/1902 | Traxton | |
| 738,486 | A | 9/1903 | Rogers | |
| 816,517 | A | 3/1906 | Whalen | |
| 1,835,723 | A | 12/1931 | Salzer | |
| 2,984,419 | A | 5/1961 | McOuat | |
| 3,682,392 | A * | 8/1972 | Kint, Louis F. | 239/428.5 |
| 3,722,798 | A * | 3/1973 | Bletcher et al. | 239/428.5 |
| 3,722,800 | A * | 3/1973 | Shames et al. | 239/447 |
| 3,853,761 | A | 12/1974 | McClory | 210/100 |
| 3,929,287 | A | 12/1975 | Givler et al. | 239/102 |
| 4,107,046 | A | 8/1978 | Corder | 210/282 |
| 4,162,028 | A * | 7/1979 | Reichenberger | 222/129.4 |
| 4,172,796 | A | 10/1979 | Corder | 210/238 |
| 4,311,279 | A * | 1/1982 | Jette | 239/562 |
| 4,378,124 | A | 3/1983 | Weirich et al. | 285/137 R |

(Continued)

FOREIGN PATENT DOCUMENTS

DE 25 39 210 A 1 3/1977

(Continued)

OTHER PUBLICATIONS

U.S. Appl. No. 11/459,215, filed Jul. 21,2006, Nobili.

*Primary Examiner*—Len Tran
*Assistant Examiner*—Steven Cernoch
(74) *Attorney, Agent, or Firm*—Seed IP Law Group PLLC

(57) ABSTRACT

Sink spray head with supply jet variation and flow rate regulation, comprising a body defining at least two distinct water supply areas in communication with a distribution chamber controlled by a diverting cut-off driven by means of two distinct selection keys accessible outside the body, a cut-off being also provided for the regulation of the water flow rate. The keys are operatively connected to the regulation cut-off.

21 Claims, 8 Drawing Sheets

U.S. PATENT DOCUMENTS

| | | | | | |
|---|---|---|---|---|---|
| 4,629,125 | A | | 12/1986 | Liu | 239/443 |
| 4,770,768 | A | | 9/1988 | Lang | 210/94 |
| 4,863,103 | A | | 9/1989 | Gannaway | 239/289 |
| 4,907,744 | A | | 3/1990 | Jousson | 239/449 |
| 5,020,569 | A | | 6/1991 | Agresta | 137/544 |
| 5,145,114 | A | | 9/1992 | Mönch | 239/126 |
| 5,152,464 | A | | 10/1992 | Farley | 239/553.3 |
| 5,383,604 | A | * | 1/1995 | Boesch | 239/447 |
| 5,417,348 | A | | 5/1995 | Perrin et al. | 222/129.1 |
| 5,467,927 | A | | 11/1995 | Lee | 239/383 |
| 5,545,322 | A | | 8/1996 | Cheng | 210/440 |
| 5,615,837 | A | * | 4/1997 | Roman | 239/530 |
| 5,735,467 | A | | 4/1998 | Lee | 239/414 |
| 5,744,033 | A | | 4/1998 | Bertrand et al. | 210/282 |
| 5,823,229 | A | * | 10/1998 | Bertrand et al. | 137/614.2 |
| 5,853,130 | A | | 12/1998 | Ellsworth | 239/548 |
| 5,858,215 | A | * | 1/1999 | Burchard et al. | 210/87 |
| 5,865,209 | A | | 2/1999 | Vidal | 137/216 |
| 5,884,808 | A | * | 3/1999 | Muderlak et al. | 222/23 |
| 5,888,381 | A | | 3/1999 | Primdahl et al. | 210/87 |
| 5,976,362 | A | | 11/1999 | Wadsworth et al. | 210/87 |
| 5,983,938 | A | | 11/1999 | Bowers et al. | 137/625.17 |
| 5,993,648 | A | | 11/1999 | Hunter et al. | 210/94 |
| 6,000,626 | A | * | 12/1999 | Futo et al. | 239/74 |
| 6,003,170 | A | | 12/1999 | Humpert et al. | 4/623 |
| 6,074,552 | A | | 6/2000 | Allen | 210/138 |
| 6,093,313 | A | | 7/2000 | Bovaird et al. | 210/94 |
| 6,145,757 | A | * | 11/2000 | Knapp | 239/443 |
| 6,176,438 | B1 | * | 1/2001 | Sato et al. | 239/119 |
| 6,290,147 | B1 | | 9/2001 | Bertrand et al. | 239/444 |
| 6,368,503 | B1 | | 4/2002 | Williamson et al. | 210/282 |
| 6,517,720 | B1 | | 2/2003 | Aldred et al. | 210/282 |
| 6,619,567 | B1 | * | 9/2003 | Ouyoung | 239/441 |
| 6,696,944 | B2 | | 2/2004 | Knittle | 340/540 |
| 6,742,725 | B1 | | 6/2004 | Fan | 239/525 |
| 6,892,952 | B2 | * | 5/2005 | Chang et al. | 236/12.12 |
| 2004/0164183 | A1 | | 8/2004 | Nobili | 239/449 |
| 2005/0161533 | A1 | | 7/2005 | Nobili | 239/447 |
| 2006/0016912 | A1 | * | 1/2006 | Nobili | 239/525 |
| 2007/0018019 | A1 | | 1/2007 | Nobili | 239/581.1 |

FOREIGN PATENT DOCUMENTS

| | | | | |
|---|---|---|---|---|
| DE | 28 43 666 | A 1 | | 4/1980 |
| DE | 36 43 320 | A 1 | | 7/1988 |
| DE | 39 39 568 | C 1 | | 12/1990 |
| EP | 0 113 525 | B1 | | 7/1984 |
| EP | 266613 | A2 | * | 5/1988 |
| EP | 1 132 141 | A2 | | 9/2001 |
| EP | 1132141 | A2 | * | 9/2001 |
| EP | 1 577 016 | A1 | | 9/2005 |
| EP | 1577016 | A1 | * | 9/2005 |
| FR | 2 683 745 | A1 | | 5/1993 |
| GB | 1 253 959 | | | 11/1971 |

* cited by examiner

SINK SPRAY HEAD WITH SUPPLY JET VARIATION AND FLOW RATE REGULATION

BACKGROUND OF THE INVENTION

1. Field of the Invention

The present invention relates to a sink spray head with supply jet variation and flow rate regulation.

2. Description of the Related Art

As it is known, at present, sink spray heads on sale can be both of the "pulldown" type, i.e. associated with the tap pipe, or of the "pullout" type, i.e., withdrawable from the sink, and are structured in such a way as to execute the supply jet variation.

These spray heads are typically provided with two flanked keys which can be selectively activated so as to obtain an aerated central jet or, possibly, an indiscriminate peripheral jet.

These spray heads are also provided with a further key or button which gives the possibility to regulate the water flow rate until the supply is stopped.

There is a need for these types of spray heads to be provided with three distinct activation elements with both constructive and activation complexity, since if the flow rate regulation is to be executed then action is to be taken onto a key, which is different from the one that has allowed the choice of the supply jet type.

Moreover, when the closure of the water flow is executed by means of the flow rate regulation key, the spray head is inevitably positioned with the water supply in the central position, i.e., with aerated jet.

An aim of the present invention is that of realizing a sink spray head with supply jet variation and flow rate regulation, which gives the possibility to make the use of the spray head particularly simple, moreover conferring the possibility to simplify the use of the spray head.

A particular aim of the invention is that of realizing a spray head wherein the flow rate regulation executed directly by the spray head does not imply a variation of the supply jet type.

Another aim of the present invention is that of realizing a spray head which, thanks to its peculiar realization characteristics, is able to give the widest guarantees of reliability and safety of use.

Another aim of the present invention is that of realizing a spray head which can be easily obtained starting from elements and materials being commonly available on sale and which, moreover, is competitive from a merely economic point of view.

BRIEF SUMMARY OF THE INVENTION

According to the present invention, the aims cited above are realized by a sink spray head with supply jet variation and flow rate regulation, comprising a body defining at least two distinct water supply areas communicating with a distribution chamber controlled by a diverting cut-off driven by two distinct selection keys accessible outside the body, a water flow rate regulation cut-off being also provided, characterized by the fact that the selection keys are operatively connected to the water flow rate regulation cut-off.

Further characteristics and advantages of the spray head according to the present invention will be better apparent from the description of a preferred, but non exclusive, embodiment of a sink spray head with supply jet variation and flow rate regulation, shown by way of indicative and non limiting example with the help of the annexed drawings.

DETAILED DESCRIPTION OF THE INVENTION

Figure 1:
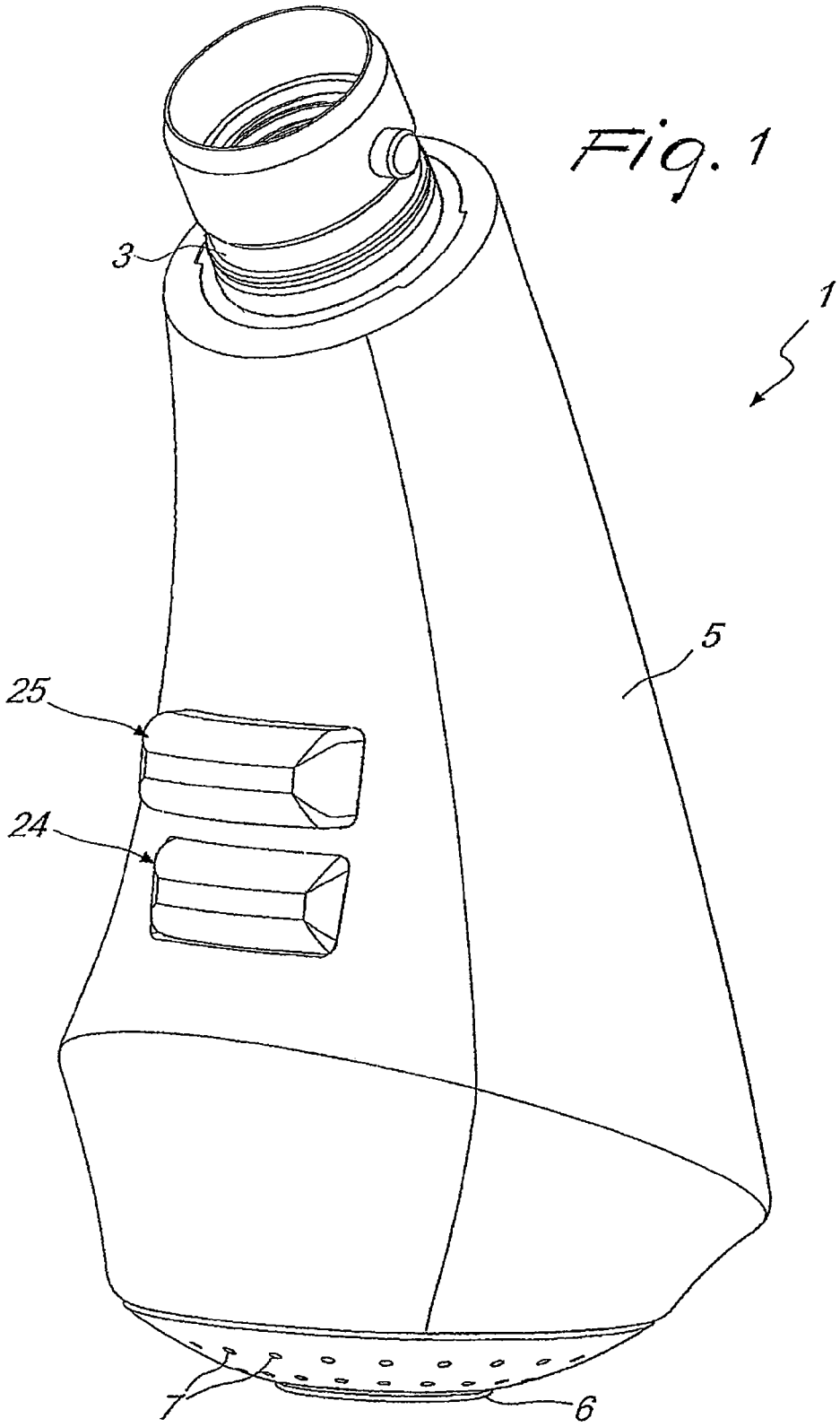
FIG. 1 schematically shows a possible embodiment of the sink spray head.
Figure 2:
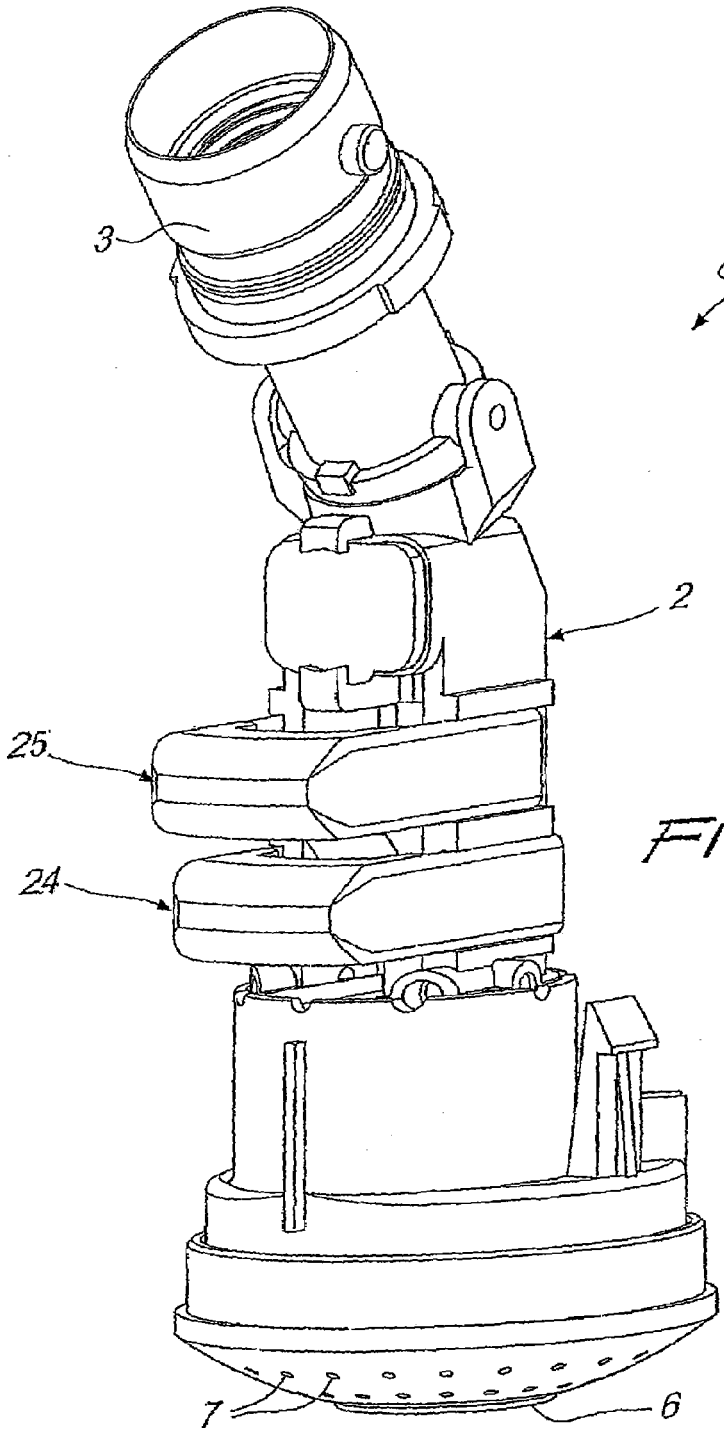
FIG. 2 shows the sink spray head of FIG. 1 where the casing or external shell has been removed.
Figure 3:
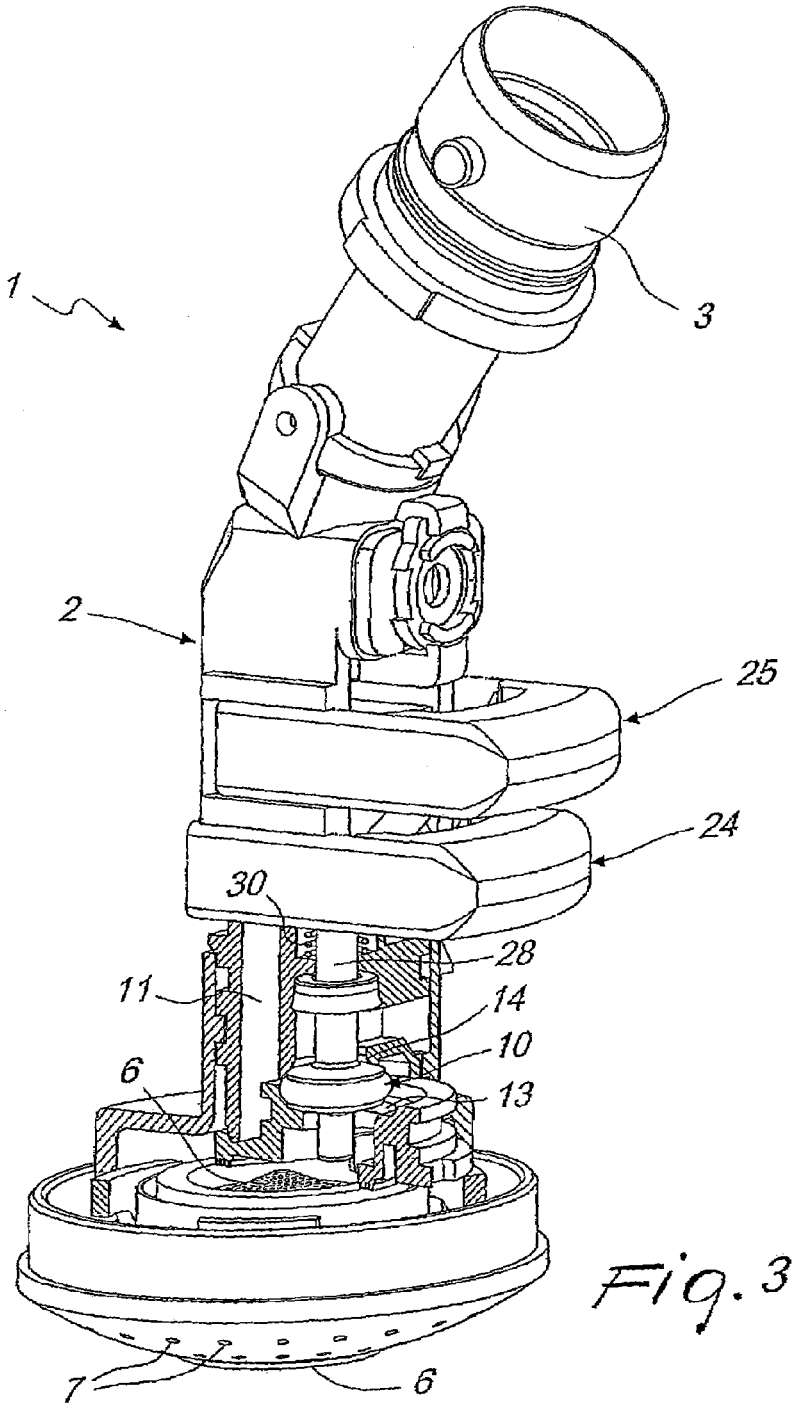
FIG. 3 shows the sink spray head of FIG. 2 where the area of the diverting cut-off has been sectioned.
Figure 4:
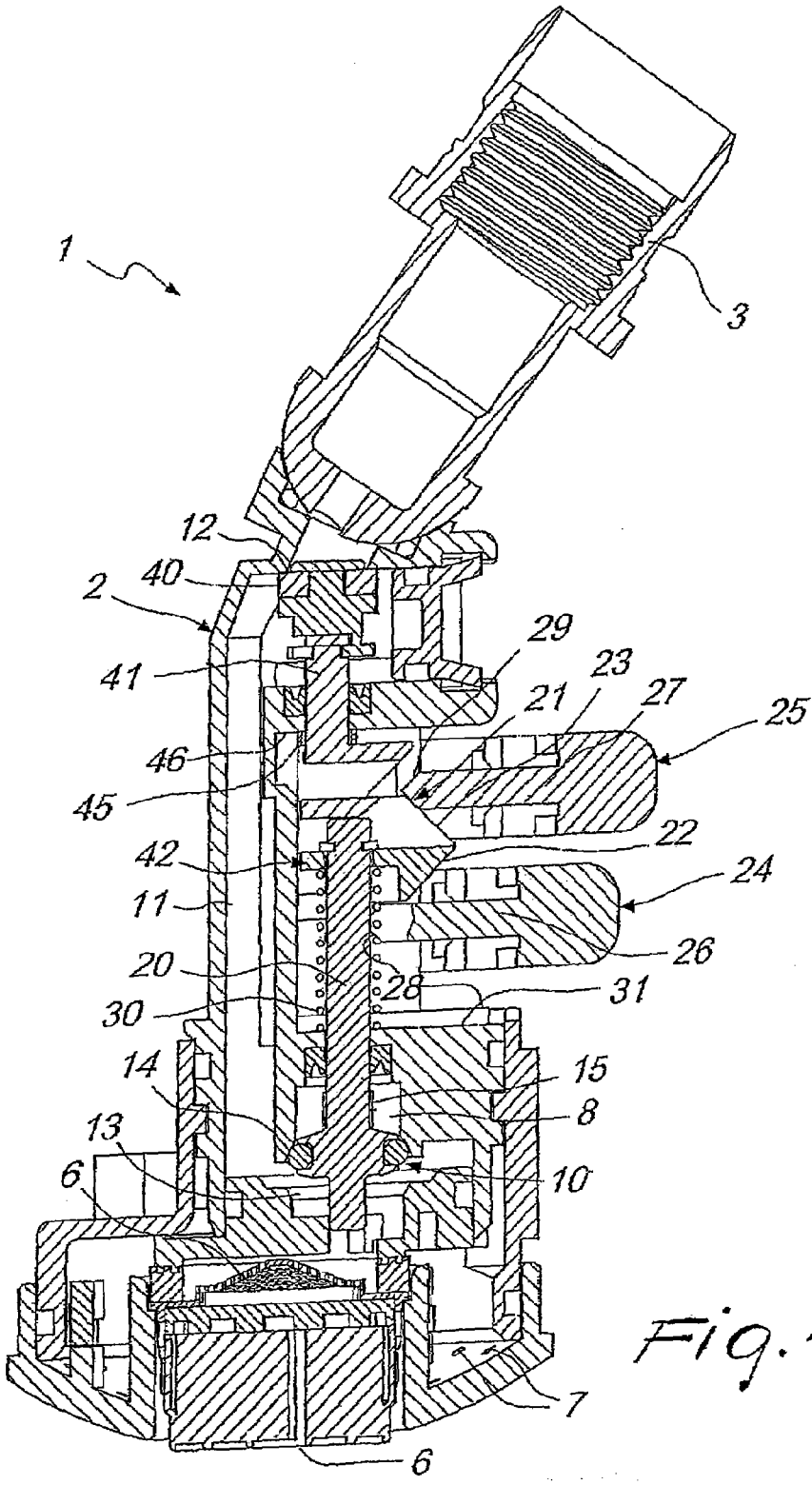
FIG. 4 shows a section view of the sink spray head positioned on the supply of the central jet and whose flow rate is closed.

With reference to the cited figures, the sink spray head with supply jet variation and flow rate regulation, according to the invention, and being indicated with reference number 1, comprises a body 2 (FIG. 2) which is connected to a mouth 3 of connection to the water supply through a ball joint 4 (FIG. 5) which gives the possibility to obtain, with the same typology of mechanism, different conformations of the spray head, thanks to the possibility to modify the conformation of the covering external shell 5, by varying the angle between mouth 3 and body 2.

The body 2 defines two distinct water supply areas which are constituted by a central area 6 for the supply of an aerated central jet and by a peripheral area 7 for the supply of an indiscriminate jet.

The areas 6 and 7 are in communication with a distribution chamber 8 wherein a diverting cut-off 10, which will be described in detail hereafter, acts.

As illustrated in FIGS. 4-8, the chamber 8 is in communication with a water delivery duct 11 which is connected to the mouth 3 through a passage port 12.

The chamber 8 defines a lower port 13 which controls the communication with the central area 6 and an upper port 14 which controls the communication with a passage hole 15 for the connection to the peripheral area 7.

The diverting cut-off 10 is connected to a small shaft 20 which is operatively associated with a first slide 21 which defines a first and a second weathering 22 and 23 opposite to each other and suitable for interacting with a first and second selection key 24 and 25 which are accessible outside the shell 5 on the external surface of the spray head.

The keys 24 and 25 are equipped with a respective stem 26 and 27, each of which ends with a double weathering end 28 and 29 which has the function of interacting with the opposite weathering sections 22 and 23 of the first slide 21.

More in detail, the first key 24, when activated, acts on the first weathering 22 causing the translation upwards (as viewed in the drawings) of the cut-off 10 which abuts onto the second port 14 placing the chamber 8 in communication with the central jet.

By acting on the second key 25, it weathering end 29 engages with the second weathering 23 causing the translation downwards (as viewed in the drawings) of the cut-off 10, with consequent closure of the first port and opening of the second port with passage of the water through the chamber 8 towards the opening 15, which is in communication with the second area 7 or peripheral area which executes a supply with an indiscriminate jet.

First elastic means are then provided constituted by a first return spring 30 which acts between an abutment spigot 31 defined inside the body 2 and the first slide 21 so as to bring, under non activation conditions, the diverting cut-off 10 back in abutment onto the second port 14, putting the delivery 11 in communication with the central jet.

An important peculiarity of the invention is that the keys 24 and 25, besides executing the selection, are also able to operate the flow rate regulation, by acting on the flow rate regulation cut-off 40 which controls the port 12 and which is associated with a second small shaft 41 connected to a second slide 42 which is equipped with two inclined ramps 43 parallel and spaced from each other which can be engaged by the ends 28 and 29 of the keys 24 and 25 which execute an extra-stroke with respect to the stroke in engagement with the slide.

For completing the assembly, second elastic means are then provided constituted by a second return spring 45 which acts between the second slide 42 and an upper spigot 46 defined by the body 2.

Figure 5:
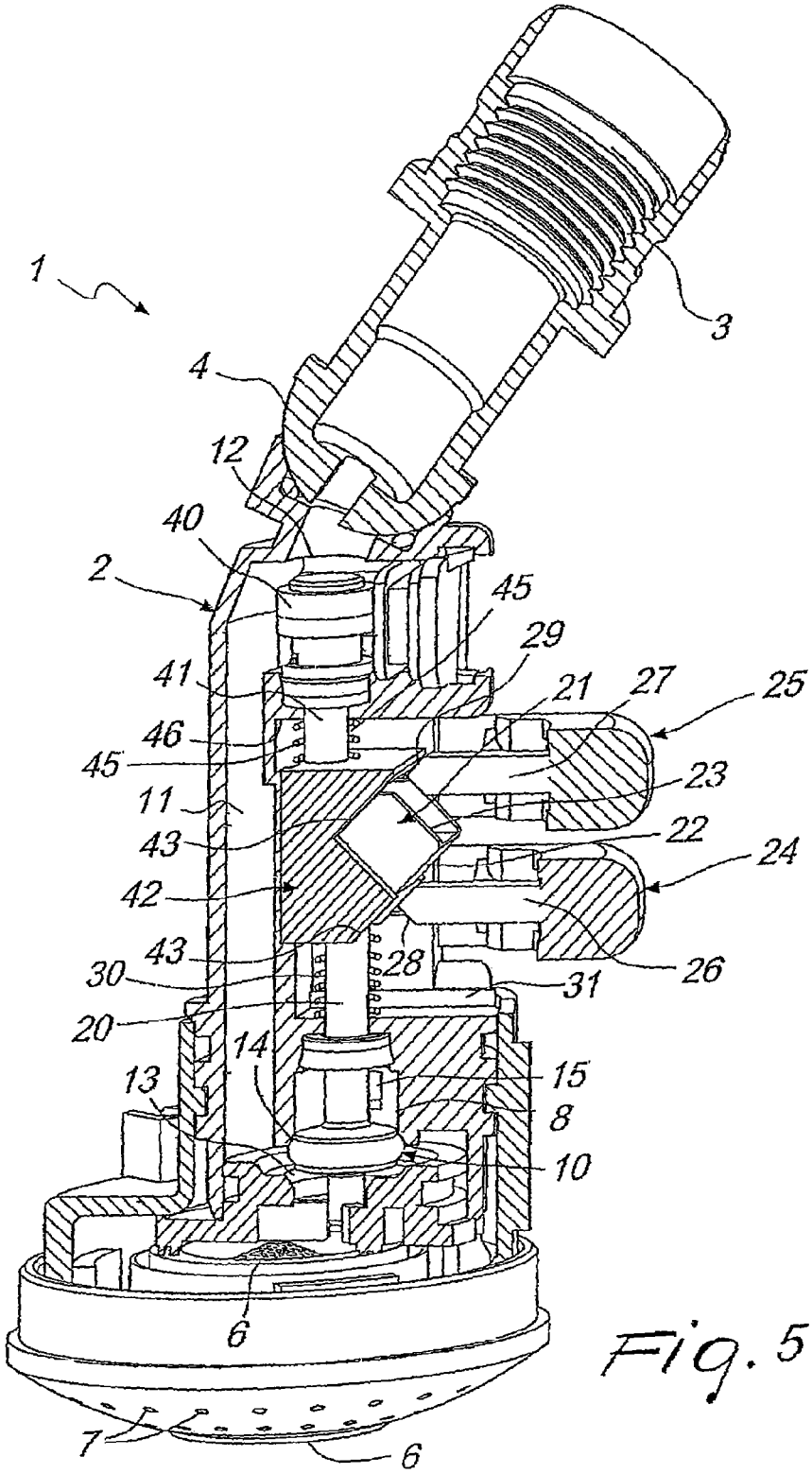
FIG. 5 schematically shows a perspective, section view of the supply from the aerated central jet.

As schematically shown in FIG. 5, the first key 24 is pressed and, acting on the first slide 21, maintains the diverting cut-off 10 in an elevated position, consequently obtaining the supply through the central area 6.

Figure 6:
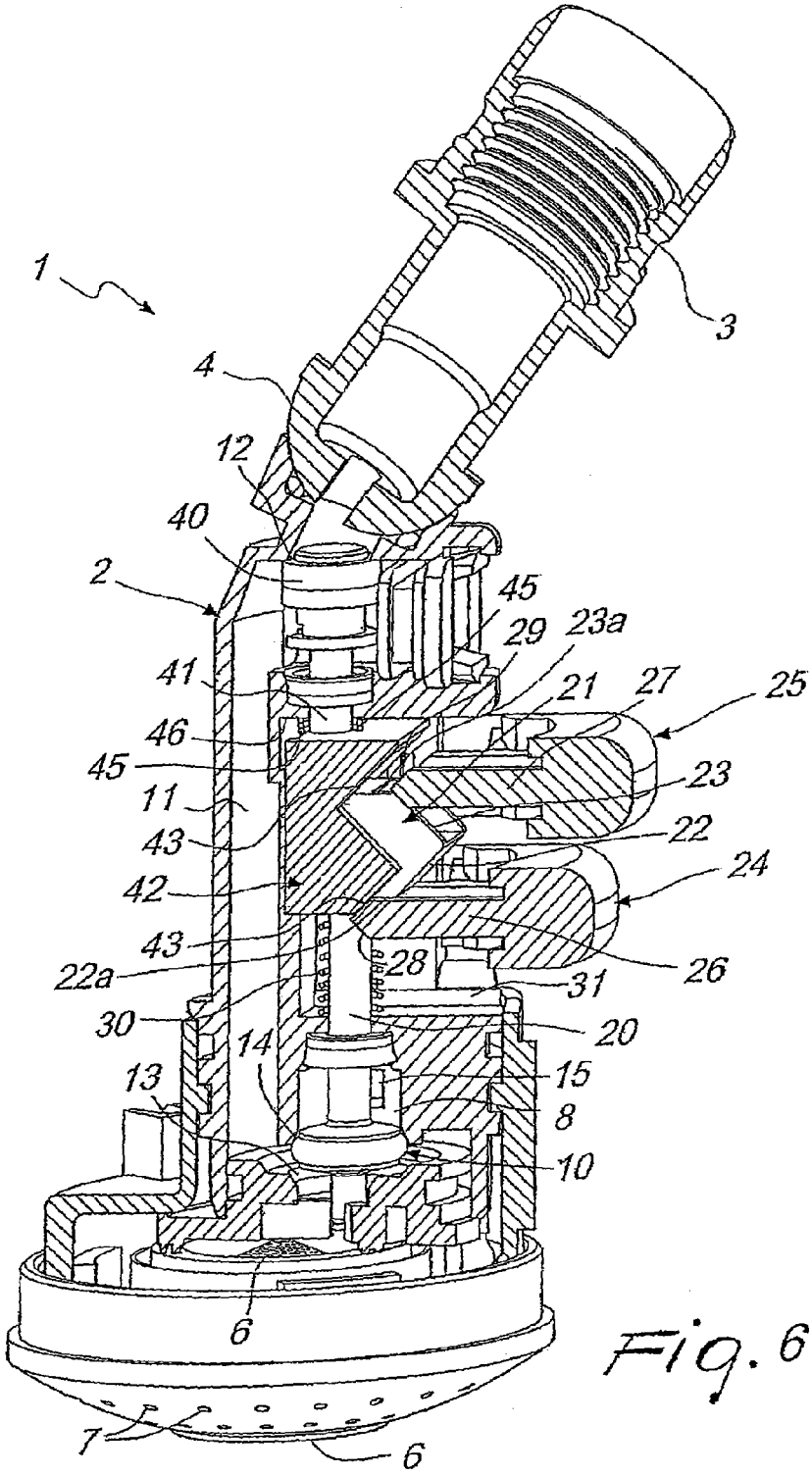
FIG. 6 schematically shows a perspective, section view of the spray head positioned for the central supply and whose flow rate is closed.

By further pressing the first key 24, as shown in FIG. 6, its double weathering end 28 engages with one of the ramps 43 of the second slide, causing the translation of the flow rate regulation cut-off 40 against the second spring 45, so that the cut-off closes the port 12 executing the blocking of the flow rate or, however, in case it is not completely pressed, a regulation of the flow rate.

It is to be noted that the stem 26 of the first key 24 is positioned, spigot-wise, on the lower edge 22*a* of the slide 21, therefore the slide 21, even when the flow rate is interrupted, by means of the key 24, can change its positioning.

Figure 7:
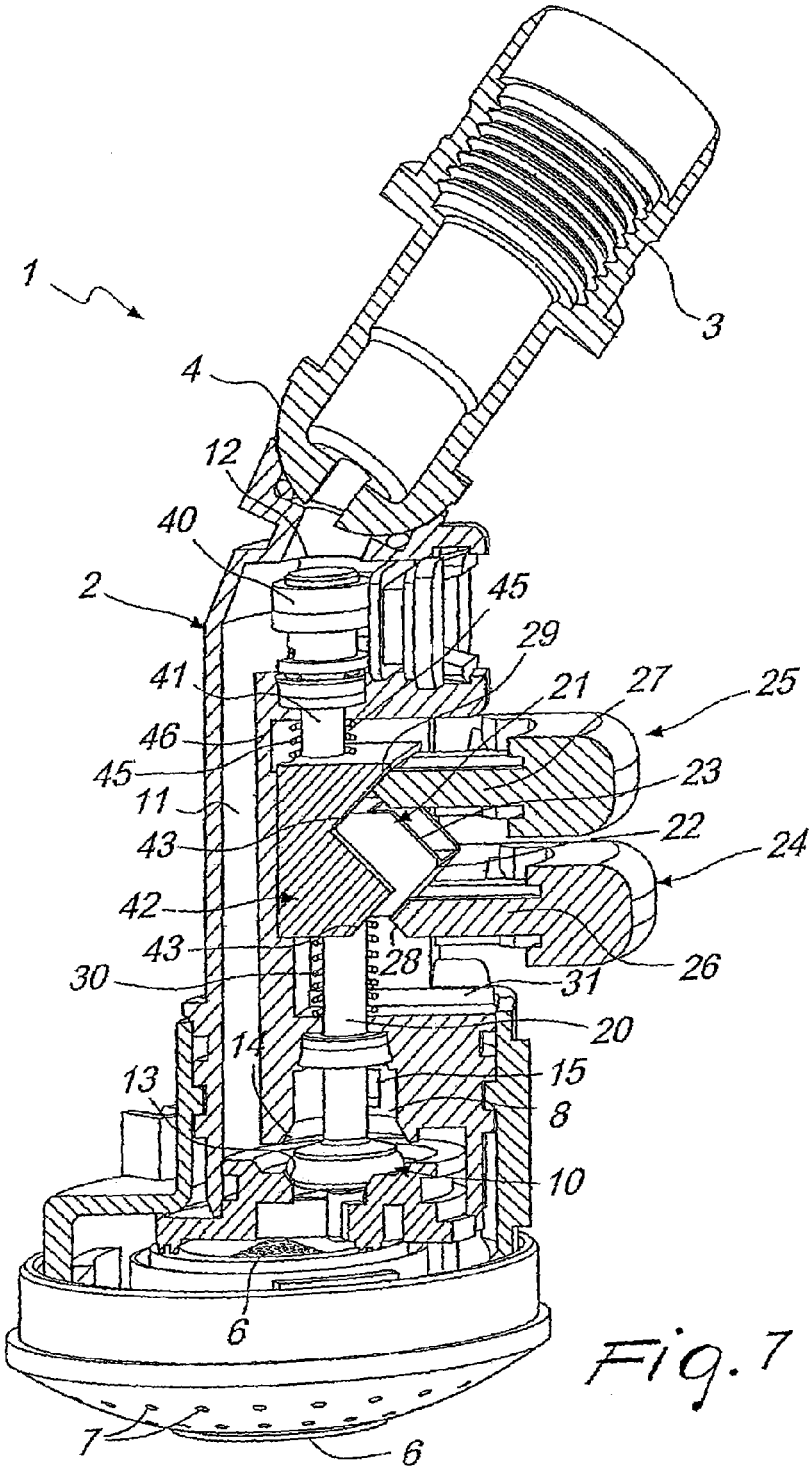
FIG. 7 schematically shows a perspective, section view of the spray head positioned for the indiscriminate peripheral supply.

As shown in FIG. 7, the second key 25 is activated and, in this case, the first slide 21 is translated downwards with passage of the water flow rate towards the surface 7.

Figure 8:
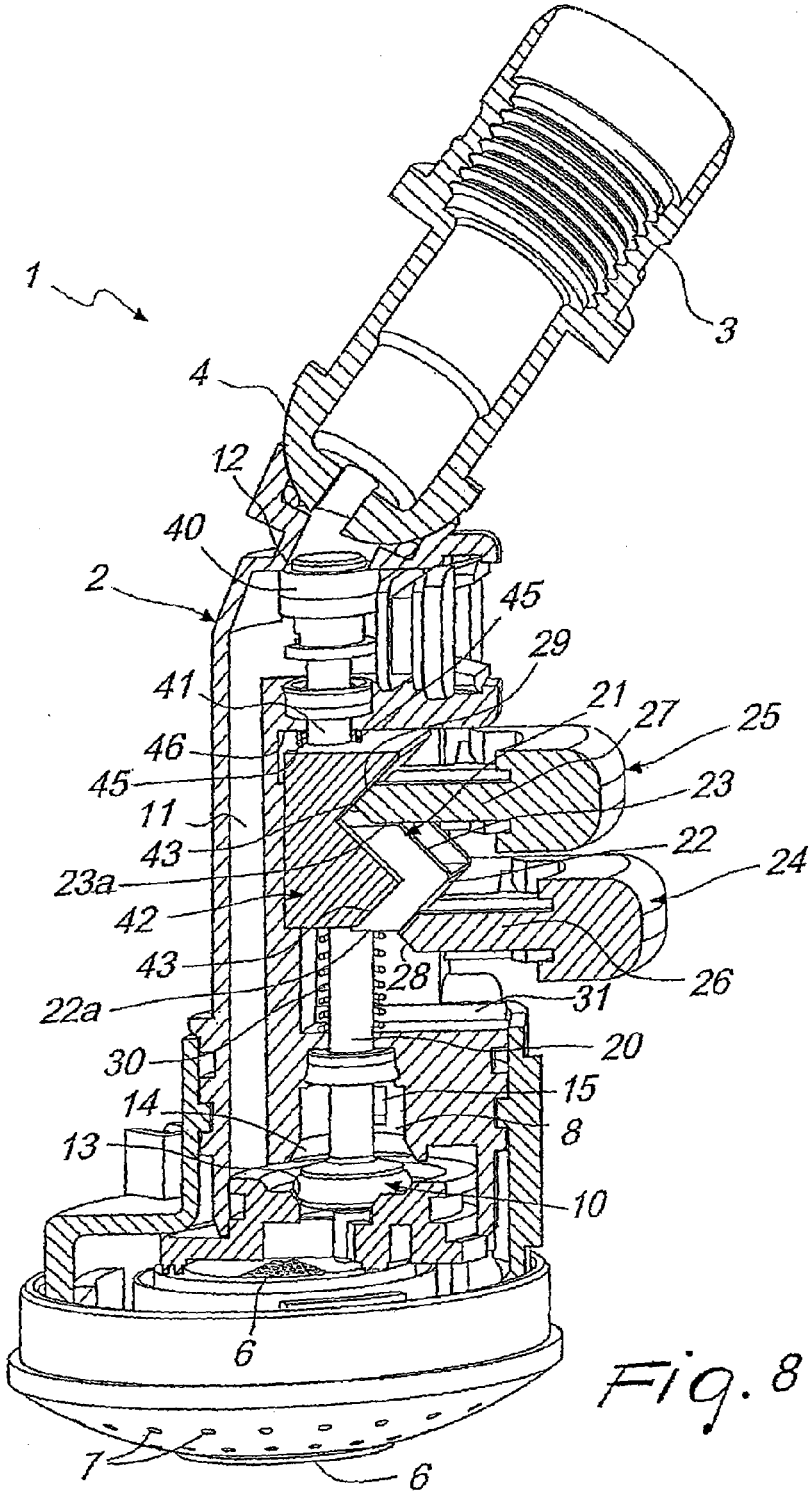
FIG. 8 shows a perspective, section view of the spray head positioned for the indiscriminate supply and whose flow rate is closed.

By further acting on the second key 25, as shown in FIG. 8, the translation of the second slide 42, which brings the cut-off to closure, is caused.

Also in this case it is to be noted that the first slide 21 maintains the position taken, since the stem 27 of the second key 25 is positioned, spigot-wise, with the upper wall 23*a* of the first slide, preventing it from modifying its positioning.

With the solution described it thus results that, even interrupting the flow, by acting on the keys 24 or 25 the positioning taken by the diverting cut-off 10 is not modified.

In case the flow is instead interrupted by acting on the tap, the first return spring 30 causes the translation of the diverting cut-off 10 upwards, making reference to the drawings, therefore the successive supply occurs, as typical, always in the central area.

As per what has been above shown, it is clear how the invention attains the proposed aims and in particular underlines the fact that a spray head is realised wherein only two activation keys are present giving the possibility to execute the variation of the supply jet, i.e., the deviation of the jet supply from the central area to the peripheral area, or vice versa, and offering the possibility, with a further stroke, to execute the flow rate regulation, since it is enough that the user further acts on the key which is, at the moment, pressed for obtaining the flow rate regulation until it is totally interrupted.

Another important aspect is that the spray head body is connected to the connection mouth 3 by means of a ball joint which allows a user to vary, at will, the relative positioning between body 2 and mouth, therefore it is possible, by maintaining the same mechanics, to vary, at will, the external conformation of the spray head.

The invention thus conceived can be subjected to several modifications and versions all within the inventive concept.

Moreover, all the details will have the possibility to be substituted by other technically equivalent elements.

In practice, the materials used, as well as the dimensions and the specific shapes, will be of any type according to the needs.

Advantageously, according to the spray head of the present invention, the flow rate regulation executed directly by the spray head does not imply a variation of the supply jet type.

The spray head, thanks to its peculiar realization features, is able to give the widest guarantees of reliability and safety of use,.

Moreover, the spray head can be easily realized starting from elements and materials being commonly available on sale and which, moreover, is competitive from a merely economic point of view.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A sink spray head with supply jet variation and flow rate regulation capabilities, the sink spray head comprising a body defining at least two distinct water supply areas in communication with a distribution chamber, flow of water from the distribution chamber to the water supply areas being controlled by a diverting first cut-off manipulable by distinct first and second selection keys accessible from outside the body, a regulation second cut-off being also provided for the regulation of the water flow rate, the first and second selection keys being operatively engageable with the second cut-off, the first and second selection keys each being equipped with a respective stem suitable for interacting with a first slide connected to the diverting first cut-off, the spray head including a second slide flanked with respect to the first slide and operatively engageable with the regulation second cut-off, the stem of the respective first and second selection keys being suitable for interacting with the second slide equipped with two inclined ramps substantially parallel to each other, both ramps suitable for being engaged by the stem of one of the first and second selection keys.

2. A sink spray head according to claim 1, wherein the spray head comprises a water delivery duct connected to the distribution chamber and defining a passage port controlled by the regulation second cut-off.

3. A sink spray head according to claim 1, wherein the distribution chamber defines a lower port controlling the communication with a central area and an upper port controlling the communication with a peripheral area of an indiscriminate jet.

4. A sink spray head according to claim 1, wherein the first slide defines a first and a second weathering opposite to each other and suitable for engaging respectively with the first selection key and the second selection key for transforming a translation of the respective first and second selection keys into a translation of a shaft of the first cut-off along a direction at least substantially perpendicular to the translation direction of the first and second selection keys.

5. A sink spray head according to claim 4, wherein the respective stems of the first and second selection keys end with a double weathering end.

6. A sink spray head according to claim 1, wherein the first and second selection keys are configured to execute an extra-stroke with respect to a stroke necessary to execute the variation of the supply jet, the extra-stroke defining the flow rate regulation through the engagement with the second slide.

7. A sink spray head according to claim 3, wherein the spray head comprises a first elastic device acting between an abutment spigot defined by the body and the first slide for bringing the diverting first cut-off back into abutment onto said upper port when a water flow determined by a tap placed upstream of the spray head is interrupted.

8. A sink spray head according to claim 7, wherein the spray head comprises a second elastic device acting between said second slide and an upper spigot defined by the body for bringing said regulation second cut-off back to an opening position at the end of the activation on the selection keys.

9. A sink spray head according to claim 6, wherein the stems of said first and second selection keys when the extra-stroke is executed engage with a side portion of said first slide for keeping it in the position taken.

10. A sink spray head according to claim 1, wherein the spray head comprises a ball joint interposed between the body and a mouth of connection to a water supply for modifying the conformation of the external shell of the spray head.

11. A spray head comprising:

a fluid distribution chamber;

a body defining at least two distinct water supply regions in fluid communication with the distribution chamber;

a diverting first cut-off configured to control water flow from the fluid distribution chamber;

a regulation second cut-off configured to regulate water flow to at least a portion of the spray head;

a first slide coupled to the diverting first cut-off;

a second slide coupled to the regulation second cut-off and including a first inclined ramp and a second inclined ramp, substantially parallel to the first inclined ramp; and first and second selection keys accessible from outside the body, each of the first and second selection keys including a stem, at least one of the stems being configured to interact with the first slide to move the diverting first cut-off and control fluid communication from the distribution chamber, at least one of the stems being configured to interact with at least one of the first and second ramps of the second slide to move the regulation second cut-off.

12. A spray head according to claim 11, further comprising:

a water delivery duct in fluid communication with the distribution chamber and including a passage port, the regulation second cut-off being configured to control flow of water through the passage port.

13. A spray head according to claim 11, wherein the at least two distinct water supply regions include a peripheral region and a central region, the distribution chamber including a first port in fluid communication with the central region, and a second port in fluid communication with the peripheral region.

14. A spray head according to claim 11, wherein the first slide defines a first weathering and a second weathering, opposed to the first weathering, the first and second weatherings being configured to engage the first and second selection keys, respectively, to transform a translation of the corresponding one of the first and second selection keys into a translation of the diverting first cut-off.

15. A spray head according to claim 14, wherein the respective stems of the first and second selection keys terminate with a double weathering end.

16. A spray head according to claim 11, wherein the at least one of the first and second selection keys is configured to engage the first slide to move the diverting first cut-off and control fluid communication from the distribution chamber upon a first activation stroke to control variation of a jet supplied from the spray head, and to engage at least one of the first and second ramps of the second slide to move the regulation second cut-off upon a second activation stroke to regulate a water flow rate supplied to the spray head.

17. A spray head according to claim 13, further comprising:

an abutment spigot formed by the body; and a first biasing device positioned between the abutment spigot and the first slide and configured to bias the diverting first cut-off into abutment with the second port when water flow upstream of the second port is interrupted.

18. A spray head according to claim 12, further comprising:

an upper spigot formed by the body; and a second biasing device positioned between the second slide and the upper spigot, the regulation second cut-off being moveable between a first closed position in which the regulation second cut-off closes the passage port and a second open position in which the regulation second cut-off opens the passage port, activation of at least one of the first and second selection keys moving the regulation second cut-off toward the first closed position, the second biasing device being configured to bias the regulation second cut-off toward the first open position upon deactivation of the first and second selection keys.

19. A spray head according to claim 16, wherein at least one of the respective stems of the first and second selection keys engages a side portion of the first slide to maintain the first slide in a desired position upon the second activation stroke.

20. A spray head according to claim 11, further comprising:

a ball joint positioned between the body and an external water supply device, the ball joint being configured to allow varying the positioning of the body with respect to the external water supply device.

21. A spray head according to claim 11, wherein the second cut-off is configured to be moved independently from one of the first and second selection keys.

* * * * *